United States Patent [19]

Weman

[11] 4,109,935

[45] Aug. 29, 1978

[54] FLAP BUCKLE

[75] Inventor: Per Olof Weman, Hasloh, Fed. Rep. of Germany

[73] Assignee: Sigmatex, A.G., Geneva, Switzerland

[21] Appl. No.: 754,211

[22] Filed: Dec. 27, 1976

Related U.S. Application Data

[63] Continuation of Ser. No. 589,990, Jun. 24, 1975, abandoned.

[51] Int. Cl.[2] ..... A44B 13/02; A47C 31/00

[52] U.S. Cl. ..... 280/747; 24/230 AP; 24/241 SB; 297/385

[58] Field of Search ..... 24/230 AP, 241 SB, 230 A; 297/325, 389; 280/747, 744

[56] References Cited

U.S. PATENT DOCUMENTS

| | | | |
|---|---|---|---|
| 3,510,151 | 5/1970 | Weman | 280/747 |
| 3,698,048 | 10/1972 | Weman | 24/241 P |
| 3,844,001 | 10/1974 | Holmberg | 297/389 |
| 3,877,116 | 4/1975 | Holmberg | 24/230 AP |
| 3,920,265 | 11/1975 | Nilsson | 297/389 |

FOREIGN PATENT DOCUMENTS

| | | | |
|---|---|---|---|
| 1,358,345 | 3/1964 | France | 24/230 AP |

*Primary Examiner*—Bernard A. Gelak
*Attorney, Agent, or Firm*—Patrick L. Henry; Ernest D. Buff

[57] ABSTRACT

A fastening for holding the loop of a safety belt in motor vehicles comprises a clasp formed with an arm of which the underside defines a slot extending lengthwise of the vehicle for the insertion thereinto of the loop, the open end of said slot being closed by a catch which is openable by a push button mounted on the clasp base.

4 Claims, 2 Drawing Figures

FLAP BUCKLE

This is a continuation of application Ser. No. 589,990, filed June 24, 1975, now abandoned.

BACKGROUND OF THE INVENTION

This invention relates to a fastening for the loop of a safety belt in motor vehicles, comprising a bracket in one embodiment affixed to the vehicle floor and in another embodiment mounted in a console to the vehicle floor and carrying a clasp of which the bottom edge defines a slot extending lengthwise of the vehicle for the reception therein of the loop.

For holding the driver or passengers in a motor vehicle during an accident it has been found that under certain conditions it is desirable to interconnect the waist belt and the shoulder belt of a three-point safety belt by a running loop. Such belts can be conveniently fitted by using a fastening into which the loop which connects the waist belt to the shoulder belt need merely be inserted, as shown for example in U.S. Pat. No. 3,698,048.

SUMMARY OF THE INVENTION

It is the object of the present invention to provide a fastening for the loop of a safety belt with a push button operated clasp, the button in location below the clasp for convenience of one hand operation and reduction in size and structural requirements.

To attain this object the present invention in one embodiment provides a fastening for holding the loop of a safety belt in motor vehicles, comprising a rigid bracket, which may be a cable, secured to the vehicle floor, a clasp carried by said bracket and provided with an arm of which the underside defines a slot having an open end preferably facing the back of the vehicle and extending lengthwise of the vehicle for the insertion thereinto of a loop of preferably a three-point safety belt, and a push button activated catch arranged for engaging the clasp, which is biased to an open position.

BRIEF DESCRIPTION OF THE DRAWING

Two embodiments of the invention will now be described by way of example and with reference to the accompanying drawing, in which.

DESCRIPTION OF THE PREFERRED EMBODIMENTS

Figure 1:
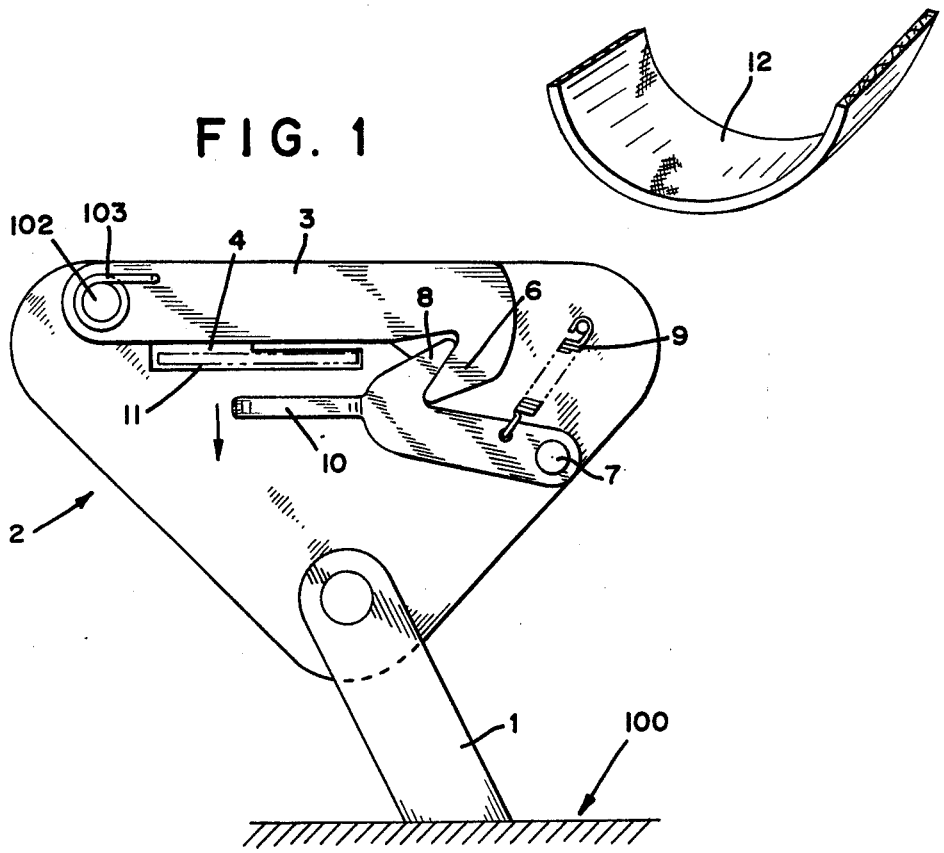
FIG. 1 is a side elevation of a clasp and a catch according to the invention.

Referring to FIG. 1, a bracket 1 which may be in the form of a cable, is rigidly affixed to the floor of a vehicle 100. A clasp 3 is pivotably mounted at 102 on the buckle 2, which is rigidly mounted to the bracket. The clasp 3 embraces a slot 4 which is open at the rear end of the clasp. The clasp 3 is so disposed that one end 20 thereof faces the back of the vehicle and the other end 22 thereof faces the front of the vehicle.

The bottom part of the buckle 2 carries a catch shoulder 8 pivoted to the buckle at 7 for engaging the hook 6 on the clasp 3. In the drawing when the clasp is in locking position, the hook 6 engages catch shoulder 8. The hook is biased to its locking position by a tension spring 9.

Figure 2:
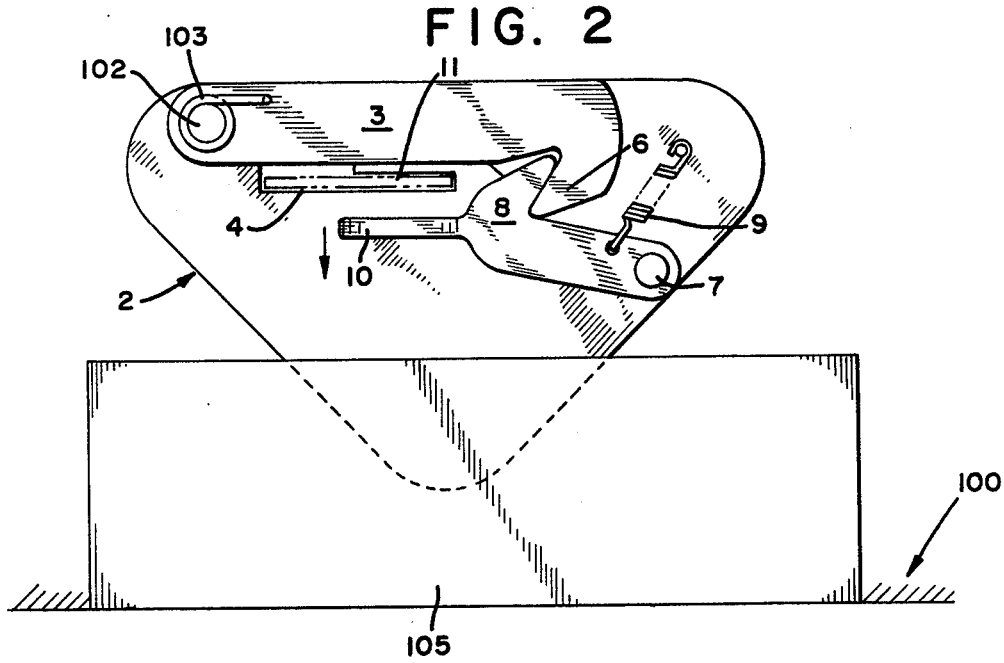
FIG. 2 is a similar view of an alternative embodiment.

As illustrated by FIGS. 1 and 2 of the drawings, when clasp 3 is in the locking position hook 6 is disposed forward of catch 8 in abutting overlapping relation therewith. In addition, the point of engagement between the hook 6 and catch 8 is adjacent to slot 4 and, hence, in close proximity to portion 24 of clasp 3 against which loop 12 of the belt pulls upon application of tensile forces thereto. This arrangement of the hook 6, catch 8 and slot 4 provides for an especially strong engagement between the hook 6 and catch 8 and prevents clasp 3 from being disengaged from the locking position by inertia forces applied to the hook 6 and catch 8 upon sudden deceleration of the vehicle.

By pushing the button 10 in the direction indicated by the arrow, the hook 6 can be easily released from the catch shoulder 8 to allow the clasp to move upwards and release the belt, but the hook will not release the clasp except by motion of the button applied in a direction substantially perpendicular to the vehicle floor 100. The loop 12 of the belt is inserted into the clasp through the opening into the slot 4 when it is open. The three-point safety belt can therefore be secured simply by placing the loop 12 into the slot 4 and closing the clasp 3 until it catches the hook 6. The clasp 3 is biased to an open position by spring 103, for example, at the pivot 102.

In one embodiment, the push button 10 is advantageously formed as an integral part of the hook 6, as well as below the clasp and webbing held thereunder. When the button 10 is depressed against the bias of the spring 9, the hook 6 disengages from the clasp catch 8 and the buckle axis. The button 10 is provided in a simple and compact alignment below the clasp 3 and webbing 12 when in the clasp (which is shown as within the clasp in position at 11). The button 10 is arranged so as to provide for movement substantially perpendicular to the floor of the vehicle 10, which allows for ease and simplicity of operation.

Alternately, the push button 19 can advantageously be formed separate from the hook 6 but dissociated in its movement therewith, so that when pressed down it moves the hook into disengagement without being integrally a part thereof, allowing the hook to be a light and maneuverable structure, as well as a completely flat stamping.

The embodiment of FIG. 2 differs from the embodiment of FIG. 1 substantially only in that the buckle 2 is shown mounted in a console 105 in the vehicle between, for example, bucket seats.

The invention may be embodied in other specific forms without departing from the spirit or essential characteristics thereof. The present embodiments are therefore to be considered as illustrative.

What is claimed is:

1. A buckle for holding a vehicle seat belt comprising:

a. means connected to a floor of said vehicle for providing rigid support to the buckle at one end;

b. clasp means pivotally mounted at one of its terminal ends to one side of said buckle forming with said buckle a slot with a bottom edge, and located at the opposite end and having a structural configuration to receive the width of the belt, said clasp means, in closed position, extending laterally across said opposite buckle end and terminating at its opposite terminal end by a hook means directed generally toward said one end of said buckle;

c. means for biasing said clasp means to a predetermined open position;

d. said slot being open at one end to permit entrance of the belt into the structural configuration of the slot;

e. said hook means being connected to said clasp means for pivotal movement therewith to a position adjacent to the open end of the slot;

f. catch means pivotally mounted at one of its ends to the other side of said buckle for engaging said hook means when said clasp is moved to a locking position to retain the webbing said catch means being a generally elongated member extending laterally across said buckle between said clasp means and the said one end of said buckle, an intermediate portion thereof having a catch shoulder extending toward said hook means, and the engagement between said hook shoulder and said catch means being adjacent to said slot;

g. push button release means connected to said catch means at its other end for releasing said hook means from said catch means on depression of said push button means;

h. biasing means urging said push button means to its nondepression position; and i. said push button means located below said clasp means and retained belt between said bottom edge of said slot and said one end of said buckle and positioned so that motion depressing it is substantially perpendicular to the vehicle floor.

2. A buckle as claimed in claim 1, said push button means being integral with said catch means.

3. A buckle as claimed in claim 2, said means for providing rigid support being a cable.

4. A buckle as claimed in claim 2, said means for providing rigid support being a floor mounted console in the vehicle.

* * * * *